US007794033B2

(12) United States Patent
Schaeffer

(10) Patent No.: US 7,794,033 B2
(45) Date of Patent: Sep. 14, 2010

(54) PRINTING SYSTEM FOR TRIGGERING THE PRINT HEAD OF A PRINTER CARTRIDGE

(75) Inventor: Werner Schaeffer, Herrenberg (DE)

(73) Assignee: APS Alternative Printing Services GMBH, Herrenberg (DE)

( * ) Notice: Subject to any disclaimer, the term of this patent is extended or adjusted under 35 U.S.C. 154(b) by 36 days.

(21) Appl. No.: 11/917,858

(22) PCT Filed: Jun. 30, 2006

(86) PCT No.: PCT/DE2006/001146

§ 371 (c)(1),
(2), (4) Date: Dec. 17, 2007

(87) PCT Pub. No.: WO2007/003174

PCT Pub. Date: Jan. 11, 2007

(65) Prior Publication Data

US 2008/0198190 A1 Aug. 21, 2008

(30) Foreign Application Priority Data

Jul. 1, 2005 (DE) ..... 10 2005 030 778

(51) Int. Cl.
*B41J 29/38* (2006.01)

(52) U.S. Cl. ..... 347/9; 347/12; 347/14

(58) Field of Classification Search ..... None
See application file for complete search history.

(56) References Cited

U.S. PATENT DOCUMENTS

| | | | | |
|---|---|---|---|---|
| 5,635,968 | A * | 6/1997 | Bhaskar et al. | 347/59 |
| 5,946,012 | A | 8/1999 | Courian | |
| 2003/0030687 | A1 * | 2/2003 | Hu et al. | 347/19 |
| 2003/0142159 | A1 | 7/2003 | Askeland | |

* cited by examiner

*Primary Examiner*—Matthew Luu
*Assistant Examiner*—Justin Seo
(74) *Attorney, Agent, or Firm*—Michael J. Striker

(57) ABSTRACT

A printing system triggers the print head of a conventional printer cartridge configured per se for water-based printing ink. The printer cartridge print head includes ink ejector elements arranged in a matrix and a heating element of an ink ejector element that is activated by use of an address signal functioning as a line signal and by use of a master signal functioning as a column signal. The master pulses of the master signal have a lesser signal amplitude than the address pulses of the address signal (AS1). The printing ink in the printer cartridge has a high proportion of alcohol.

13 Claims, 2 Drawing Sheets

PRINTING SYSTEM FOR TRIGGERING THE PRINT HEAD OF A PRINTER CARTRIDGE

BACKGROUND OF THE INVENTION

The invention relates to a printing system for triggering the print head of a printer cartridge as generically defined by the preamble to claim 1.

Known printing systems employ printer cartridges in which the print head is integrated into the printer cartridge. Such printer cartridges are conventionally filled with water-based printing ink. For printing nonabsorbent surfaces, such as plastic surfaces or aluminum or other metal surfaces, water-based printing inks are unsuitable, since on those surfaces they do not dry in an smudge-proof manner. Printing done with water-based printing ink on such surfaces is easily smeared by a person's hand, even after a relatively long time.

From U.S. Pat. No. 5,946,012 A, an inkjet printing system for printer cartridges is known, in which the ink ejector elements arranged in a matrix are triggered by means of a column signal (master signal) and a line signal (address signal). The function of triggering is described in this reference particularly in column 23, referring to FIGS. 25 through 27 given there. In the reference, heating resistors are selectively triggered by means of associated field effect transistors, so that the heating resistors generate an ink expulsion in a known manner.

SUMMARY OF THE INVENTION

The object of the invention is to create a printing system for triggering the print head of conventional printer cartridges with which good and especially smudge-proof printed results for industrial identification purposes can be achieved even on nonabsorbent surfaces.

This object is attained with the characteristics recited in claim 1. In conventional printer cartridges with an integrated print head that are intended for water-based printing ink, the heating elements of the ink ejector elements are triggered with the same voltage values for both the column and line signals of the matrix arrangement. The heating elements are actuated with relatively high, long voltage pulses. Conversely, in the subject of the present invention, it is provided that the column signals, which can also be called master signals, have master pulses that have a lesser signal amplitude than the address pulses of the address signal, which can also be called a line signal. Thus according to the invention, a splitting up of the address signals and master signals is contemplated, so that the triggering can be done here with different voltage values and preferably also with different pulse widths. As a result, an optimal outcome of printing is attained with a printing ink that has a high proportion of alcohol; as the alcohol, ethanol is preferably employed.

Experiments have shown that by this provision, printing ink with a high proportion of alcohol can be used in these conventional printer cartridges with an integrated print head, and optimal printing outcomes can be achieved on nonabsorbent surfaces that are smudge-proof even immediately after printing.

Triggering the heating elements of the ink ejector elements with low electrical energy, as provided by the invention, takes into account the fact that water-based ink has a higher boiling point than alcohol-based printing ink.

In this respect, it is advantageous if the signal amplitude of the master pulses is markedly lower than the signal amplitude of the address pulses. For instance, the signal amplitude of the master pulses may be in the range between 6 Volts and 9 Volts, while the address pulses have a signal amplitude of approximately 12 Volts. If the signal amplitude of the master pulses is in the range between 6 Volts and 9 Volts, optimal printing outcomes on various nonabsorbent surfaces have been attained with pulse widths for the address pulses in the range between 1700 ns and 2100 ns. The pulse width of the master pulses was then 2800 ns.

It can be especially advantageous to be able to adjust the pulse width of the address pulses, by means of suitable pulse width control and/or amplitude control, to desired values in order to adapt to particular applications.

It has also been found that for good printing outcomes, it may be essential that the supply voltages for generating the address pulses and the master pulses be derived from separate voltage sources, each of them regulated. In this way, the signals are reliably prevented from affecting one another.

It is especially advantageous if the printer cartridge with the print head that is used is a conventional printer cartridge, which is intrinsically intended for water-based inks. Such printer cartridges with an integrated print head are highly reliable in operation and, as a mass-produced product, correspondingly economical to procure.

If this kind of conventional printer cartridge is used, then the printing system of the invention can optionally also be embodied as an adaptation interface between a conventional controller and the associated conventional printer cartridges.

It is moreover proposed that the printing ink for use in a printer cartridge of the printing system of the invention have a volumetric proportion of alcohol of over 70%. Preferably, one or more additives, which make it possible to use the ethanol-based printing ink in a conventional printer cartridge and/or improve the properties, for instance with regard to background moistening, adhesion, and drying performance of the ink, are added to the printing ink.

BRIEF DESCRIPTION OF THE DRAWINGS

The invention will be described in further detail below in terms of an exemplary embodiment shown in the drawings.

Shown are.

DETAILED DESCRIPTION OF THE INVENTION

Figure 1:
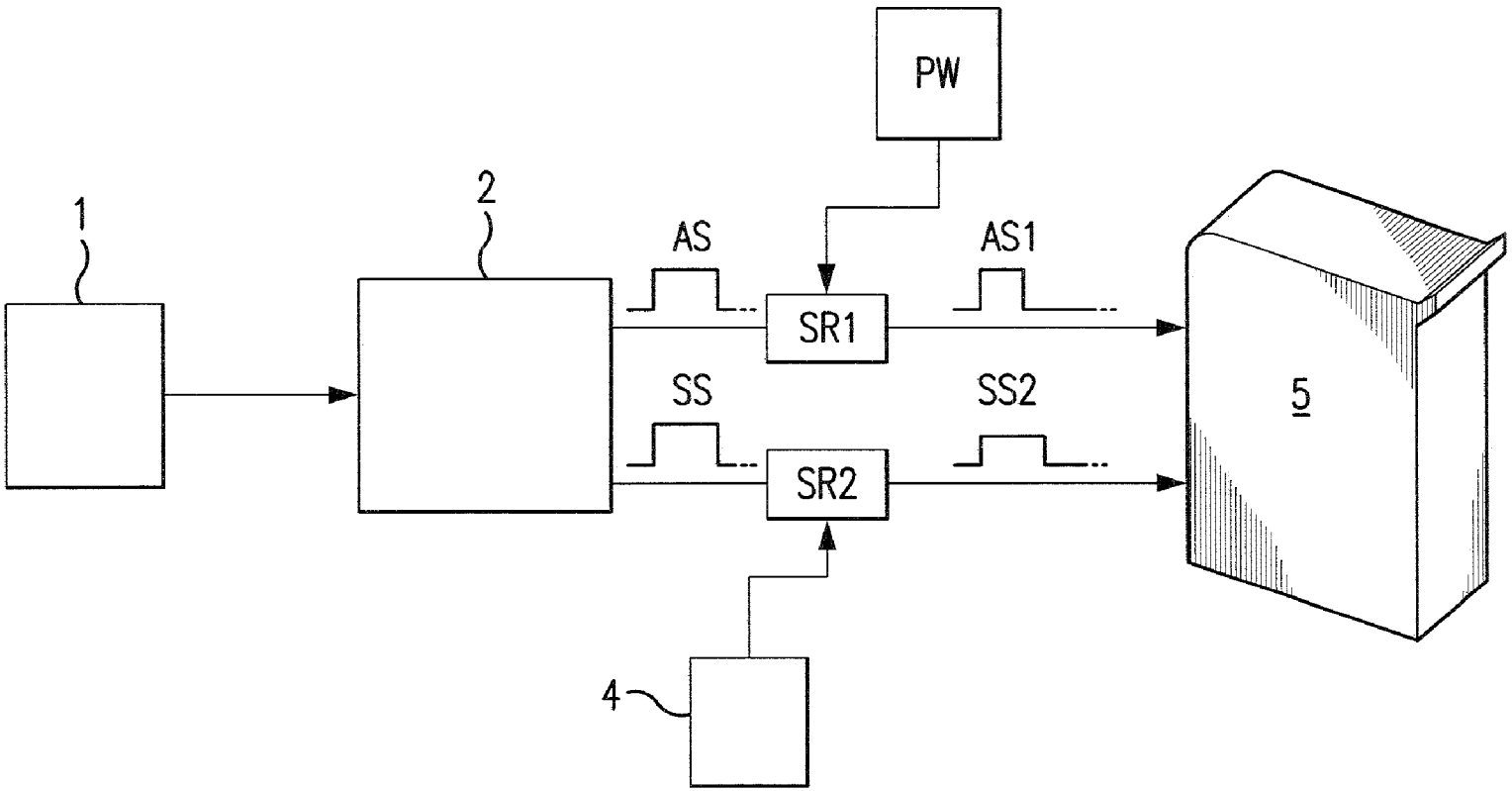
FIG. 1, the printing system in the form of a block diagram.

A desired printing job can be input to the printing system shown in FIG. 1 via an input unit 1. In a conventional system controller 2, this job is converted into suitable address signals AS and master signals SS, which are intrinsically suitable for triggering a conventional printer cartridge having an integrated print head. Downstream signal regulators SR1 and SR2 now on the output end output the suitable signal patterns for triggering a print head in the printer cartridge filled with alcohol-based printing ink. By means of a pulse width controller PW, the address pulses of the address signal AS are reduced in their pulse width, so that the address pulses have a lesser pulse width than the master pulses; this represents the preferred embodiment. Thus the master signal SS2 that appears at the output of SR2 has a lower pulse amplitude, fixedly set by means of a regulated voltage supply 4, than the address signal AS1. The change of the original master signal SS to the master signal SS2 on the output end takes place in the signal regulator SR2, which by means of a regulated voltage supply 4 performs the conversion of the master signal SS to the reduced-voltage master signal SS2. The address signal AS1 and the master signal SS2 are now used for triggering the print head in the printer cartridge 5. In this operation, the master signal SS2 in combination with the address signal AS1 is definitive for the triggering and the accordingly ensuing heating up of the heating elements of the ink ejector elements of the print head. As a result of this heating, the printing ink is known to be heated and thereby expelled in the form of small ink droplets at the print head.

A printer cartridge triggered in this way, which is filled with an alcohol-based printing ink with a volumetric proportion of alcohol of far more than 70%, preferably in the range between 80% and 95%, is very well suited for printing non-absorbent surfaces; it is understood that absorbent surfaces can also easily be printed.

A reduction in the voltage of the individual pulses of the master signal, in conjunction with an address signal that is reduced only in its pulse width, has proved to attain the best smudge-proof printing outcomes.

Figure 2:
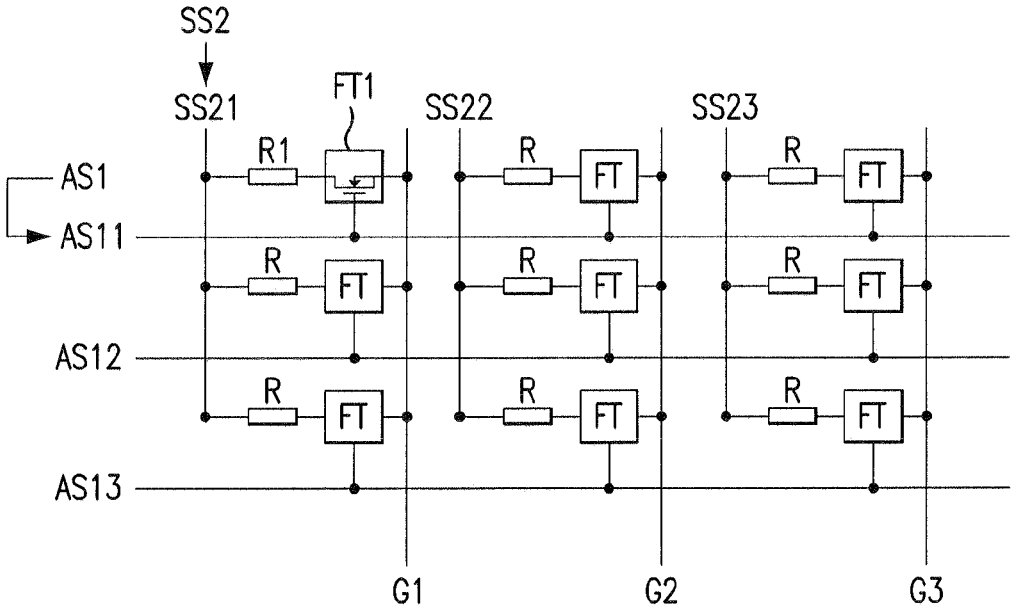
FIG. 2, a detail of a matrix arrangement of the ink ejector elements that form the print head.

The matrix arrangement of FIG. 2 shows that the heating resistors R, which form the heating elements of the individual ink ejector elements, are arranged in a matrix and triggered by respective associated field effect transistors FT. It is possible for a common reference potential—direct voltage or ground potential—to be applied to the lines G1 through G3. The master signals and address signals can be input to a plurality of columns and lines of the matrix, so that the term column signals (master signals) and line signals (address signals) can also be used. In the matrix shown here only in part, which can certainly include 300 heating elements, master signals SS2 can be delivered separately to the master lines SS21 through SS23, while correspondingly address signals AS1 can be delivered individually to the address lines AS11 through AS13.

In order to trigger for instance the heating element R1, shown at top left, for an ink expulsion, it is necessary that the master line SS21 and the address line AS11 each be supplied simultaneously with a master signal SS2 of low voltage and an address signal AS1 with a low pulse width, and it must be ensured that the address pulse be within the larger time slot of the associated master pulse of the master signal SS2 at the field effect transistor FT1.

Depending on the nature of the printing ink used, an individual adjustment of the pulse widths and pulse voltages may be expedient.

Figure 3:
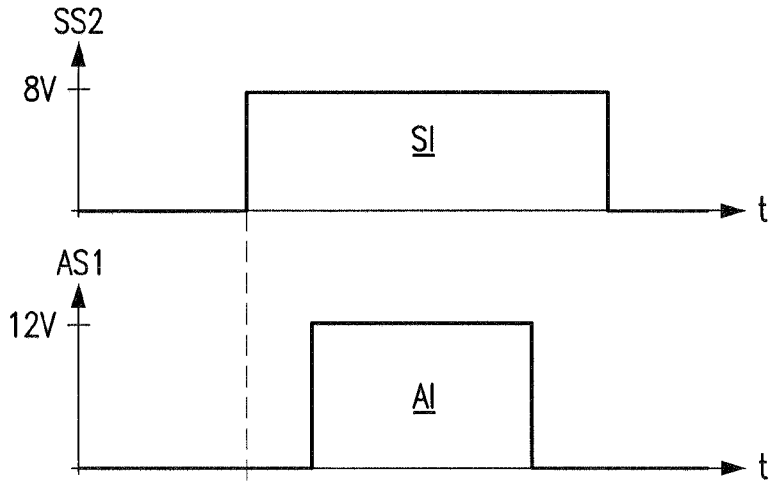
FIG. 3, an illustration of the address pulses and the master pulses.

In FIG. 3, the chronological coordination of the master pulse SI and address pulse AI is shown, both based on the same time basis t. The pulse amplitudes here are 8 Volts (SS2) and 12 Volts (AS1).

What is claimed is:

1. A printing system for triggering the print head of a conventional printer cartridge (5) which is intended per se for water-based printing ink and include a print head that has ink ejector elements arranged in a matrix, and wherein a particular heating element to be actuated of an ink ejector element is activated by means of an address signal (AS) functioning as a line signal and by means of a master signal (SS) functioning as a column signal, comprising:

signal regulator means for regulating the master signal (SS) and the address signal (AS);

regulating means for operating on address pulses of the address signal (AS) to generate an address signal (AS1); and regulating means for operating on master pulses of the master signal (SS) to generate a master signal (SS2);

characterized in that the master pulses of the master signal (SS2) have a lesser signal amplitude than the address pulses of the address signal (AS1) and that the printing ink in the printer cartridge (5) has a volumetric proportion of alcohol of over 70%.

2. The printing system as defined by claim 1, characterized in that the address pulses of the address signal (AS1) have a lesser pulse width than the master pulses of the master signal (SS2).

3. The printing system as defined by claim 1, characterized in that the master pulses of the master signal (SS2) have a lesser pulse width than the address pulses of the address signal (AS1).

4. The printing system as defined by claim 1, characterized in that the address pulses of the address signal (AS1) have a pulse width in the range between 1700 ns and 2100 ns, and the master pulses of the master signal (SS2) have a pulse width of approximately 2800 ns.

5. The printing system as defined by claim 1, characterized in that the signal amplitude of the master pulses is in the range between 6 Volts and 9 Volts.

6. The printing system as defined by claim 1, characterized in that the signal amplitude of the address signal (AS1) is approximately 12 Volts.

7. The printing system as defined by claim 1, characterized in that the pulse width and/or signal amplitude of the master pulses and/or address pulses is individually adjustable.

8. The printing system as defined by claim 1, characterized in that regulating means for generating address signals (AS1) and the regulating means for generating master signals (SS2) comprise a pulse width controller and a separate, regulated power supply, respectively.

9. The printing system as defined by claim 1, characterized in that the printing system acts as an adaptation interface between a conventional print head controller and the associated conventional printer cartridges (5) with integrated print heads, and wherein said signal regulator means comprise signal regulators SR1 and SR2 for varying at least one of the master pulses of master signal (SS) and the address pulses of address signal (AS) to generate master signal (SS2) and address signal (AS1), respectively.

10. The printing system as defined by claim 1, characterized in that the alcohol base of the printing ink comprises one, two, or more different types of alcohol.

11. The printing system as defined by claim 1, characterized in that one or more additives, which make it possible to use the printing ink in a conventional printer cartridge and/or improve the properties, for instance with regard to background moistening, adhesion, and drying performance of the ink, are added to the printing ink.

12. The printing system as defined by claim 1, characterized in that the alcohol-based printing ink contains dye or pigment and binders.

13. The printing system as defined by claim 1, characterized in that the printing ink contains ethanol as the alcohol.

* * * * *